US010777155B1

(12) United States Patent
Chuang et al.

(10) Patent No.: US 10,777,155 B1
(45) Date of Patent: Sep. 15, 2020

(54) METHOD FOR CONTROLLING POLARITY OF EACH SUBPIXELS OF DISPLAY PANEL BY USING PATTERN DETECTION MANNER

(71) Applicant: HIMAX TECHNOLOGIES LIMITED, Tainan (TW)

(72) Inventors: Ho-Sheng Chuang, Tainan (TW); Shih-Yu Wen, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/513,680

(22) Filed: Jul. 16, 2019

(51) Int. Cl.
*G09G 3/36* (2006.01)

(52) U.S. Cl.
CPC ..... *G09G 3/3614* (2013.01); *G09G 3/3648* (2013.01); *G09G 2300/0823* (2013.01); *G09G 2320/0626* (2013.01)

(58) Field of Classification Search
CPC ... G09G 2300/0823; G09G 2320/0626; G09G 3/3614; G09G 3/3648
See application file for complete search history.

(56) References Cited

U.S. PATENT DOCUMENTS

2001/0004253 A1* 6/2001 Fukutoku ..... G09G 3/3614 345/96
2005/0206595 A1* 9/2005 Park ..... G09G 3/20 345/87
2006/0097967 A1* 5/2006 Lee ..... G09G 3/3614 345/87
2009/0195529 A1* 8/2009 Nam ..... G09G 3/3648 345/213
2012/0113154 A1* 5/2012 Ge ..... G09G 3/3614 345/690
2013/0241900 A1 9/2013 Ge et al.
2015/0302812 A1* 10/2015 Jeong ..... G09G 3/3614 345/209
2016/0118001 A1* 4/2016 Ahn ..... G09G 3/3607 345/690
2016/0189641 A1* 6/2016 Son ..... G09G 3/3607 345/205
2016/0189642 A1* 6/2016 Shin ..... G09G 3/3655 345/690
2016/0335966 A1* 11/2016 Kumagai ..... G09G 3/3677
(Continued)

FOREIGN PATENT DOCUMENTS

CN 107305758 A 10/2017
TW 200627355 A 8/2006
(Continued)

*Primary Examiner* — Hong Zhou
(74) *Attorney, Agent, or Firm* — CKC & Partners Co., LLC

(57) ABSTRACT

A method for controlling polarity of each subpixels of a display panel by using a pattern detection manner is provided. The method includes the following steps: receiving image data of each subpixels of the display panel, in which the image data of the subpixels corresponds to an image pattern displayed on the display panel; performing the pattern detection manner to determine whether the image pattern is a killer pattern which induces occurrence of horizontal stripes on the display panel; employing a 1-column inversion method to drive the display panel when the image pattern is not the killer pattern; and employing a 2-column inversion method to drive the display panel when the image pattern is the killer pattern.

9 Claims, 4 Drawing Sheets

(56) References Cited

U.S. PATENT DOCUMENTS

| | | | | |
|---|---|---|---|---|
| 2017/0256228 | A1* | 9/2017 | Lee | G09G 3/3614 |
| 2018/0226045 | A1* | 8/2018 | Sohn | G02F 1/13306 |
| 2019/0206349 | A1* | 7/2019 | An | G09G 3/3674 |

FOREIGN PATENT DOCUMENTS

| | | | |
|---|---|---|---|
| TW | 201145242 | A | 12/2011 |
| TW | 201306011 | A | 2/2013 |

* cited by examiner

| subpixel No. | 1 | 2 | 3 | 4 | 5 | 6 | 7 | 8 | |
|---|---|---|---|---|---|---|---|---|---|
| i row | +255 | -0 | +255 | -0 | +255 | -0 | +255 | -0 | |
| i+1 row | +0 | -255 | +0 | -255 | +0 | -255 | +0 | -255 | |
| variance from i row to i+1 row | -255 | -255 | -255 | -255 | -255 | -255 | -255 | -255 | (sum : -2040) |

FIG. 2A

| subpixel No. | 1 | 2 | 3 | 4 | 5 | 6 | 7 | 8 | |
|---|---|---|---|---|---|---|---|---|---|
| i row | +255 | -0 | -255 | +0 | +255 | -0 | -255 | +0 | |
| i+1 row | +0 | -255 | -0 | +255 | +0 | -255 | -0 | +255 | |
| variance from i row to i+1 row | -255 | -255 | 255 | 255 | -255 | -255 | 255 | 255 | (sum : 0) |

FIG. 2B

METHOD FOR CONTROLLING POLARITY OF EACH SUBPIXELS OF DISPLAY PANEL BY USING PATTERN DETECTION MANNER

BACKGROUND

Field of Invention

The present invention relates to a pattern detection manner. More particularly, the present invention relates to a method for controlling polarity of each subpixels of a display panel by using a pattern detection manner.

Description of Related Art

Polarity inversion is a technique used in liquid crystal display panel to eliminate image retention caused by long-time DC biasing. However, when using the polarity inversion in which the positive and negative poles of the voltage applied to liquid crystals are alternated for each frame, horizontal stripes may occur due to the limitation of withstand voltage of electrode driving circuit.

SUMMARY

The present invention provides a method for controlling polarity of each subpixels of a display panel by using a pattern detection manner. The method includes the following steps: receiving image data of each subpixels of the display panel, in which the image data of the subpixels corresponds to an image pattern displayed on the display panel; performing the pattern detection manner to determine whether the image pattern is a killer pattern which induces occurrence of horizontal stripes on the display panel; employing a 1-column inversion method to drive the display panel when the image pattern is not the killer pattern; and employing a 2-column inversion method to drive the display panel when the image pattern is the killer pattern.

In accordance with one or more embodiments of the invention, when the display panel is driven by the 1-column inversion method, polarities of the subpixels in each rows are repetitively in a polarity sequence of "+, +, −"; wherein when the display panel is driven by the 2-column inversion method, polarities of the subpixels in each rows are repetitively in a polarity sequence of "+, −, −, +".

In accordance with one or more embodiments of the invention, the pattern detection manner includes the following steps: setting a failed count as 0; performing a judgement process on the subpixels in i row and i+1 row of the display panel, in which i=1, 2, . . . , N−1, in which N is number of rows of the display panel; determining that the image pattern is the killer pattern when the failed count is less than N/4; and determining that the image pattern is not the killer pattern when the failed count is not less than N/4. The judgement process includes the following steps: determining that a brightness tone of each subpixels in i row and i+1 row is a bright tone, an intermediate tone, or a dark tone; determining whether a brightness tone sequence of the brightness tones of the subpixels of first four pixels in i row is the same as a brightness tone sequence of the brightness tones of the subpixels of the other four pixels in i row; determining whether a brightness tone sequence of the brightness tones of the subpixels of first four pixels in i+1 row is the same as a brightness tone sequence of the brightness tones of the subpixels of the other four pixels in i+1 row; performing a brightness tone variation judgement process to determine whether the brightness tones of the subpixels in i row and i+1 row induce occurrence of the horizontal stripes; and adding the failed count to one when the brightness tone sequence of the brightness tones of the subpixels of first four pixels in i row is not the same as the brightness tone sequence of the brightness tones of the subpixels of the other four pixels in i row, or when the brightness tone sequence of the brightness tones of the subpixels of first four pixels in i+1 row is not the same as the brightness tone sequence of the brightness tones of the subpixels of the other four pixels in i+1 row, or when the brightness tones of the subpixels in i row and i+1 row do not induce occurrence of the horizontal stripes.

In accordance with one or more embodiments of the invention, the brightness tone of the subpixel is determined by comparing a gray level of the subpixel with a bright threshold and a dark threshold. The brightness tone of the subpixel is determined as the bright tone when the gray level of the subpixel is larger than the bright threshold. The brightness tone of the subpixel is determined as the dark tone when the gray level of the subpixel is less than the dark threshold. The brightness tone of the subpixel is determined as the intermediate tone when the gray level of the subpixel is not larger than the bright threshold and is not less than the dark threshold.

In accordance with one or more embodiments of the invention, the brightness tone sequence of the brightness tones of the subpixels of first four pixels in i row is determined to be the same as the brightness tone sequence of the brightness tones of the subpixels of the other four pixels in i row through the following steps: setting a first difference count as 0; performing a first comparison process on the subpixels of first four pixels in i row and the subpixels of j-th four pixels in i row, in which j=2, 3, . . . , M/4, in which M is number of columns of the display panel; determining that the brightness tone sequence of the brightness tones of the subpixels of first four pixels in i row is the same as the brightness tone sequence of the brightness tones of the subpixels of the other four pixels in i row when the first difference count is less than 7. The first comparison process includes the following steps: determining whether the brightness tone sequence of the brightness tones of the subpixels of first four pixels in i row is different from the brightness tone sequence of the brightness tones of the subpixels of j-th four pixels in i row; and adding the first difference count to one when the brightness tone sequence of the brightness tones of the subpixels of first four pixels in i row is different from the brightness tone sequence of the brightness tones of the subpixels of j-th four pixels in i row.

In accordance with one or more embodiments of the invention, the brightness tone sequence of the brightness tones of the subpixels of first four pixels in i+1 row is determined to be the same as the brightness tone sequence of the brightness tones of the subpixels of the other four pixels in i+1 row through the following steps: setting a second difference count as 0; performing a second comparison process on the subpixels of first four pixels in i+1 row and the subpixels of j-th four pixels in i+1 row, in which j=2, 3, . . . , M/4, in which M is number of columns of the display panel; determining that the brightness tone sequence of the brightness tones of the subpixels of first four pixels in i+1 row is the same as the brightness tone sequence of the brightness tones of the subpixels of the other four pixels in i+1 row when the second difference count is less than 7. The second comparison process includes the following steps: determining whether the brightness tone sequence of the brightness tones of the subpixels of first four pixels in i+1 row is different from the brightness tone sequence of the brightness tones of the subpixels of j-th four pixels in i+1 row; and adding the second difference count to one when the brightness tone sequence of the brightness tones of the subpixels of first four pixels in i+1 row is different from the brightness tone sequence of the brightness tones of the subpixels of j-th four pixels in i+1 row.

In accordance with one or more embodiments of the invention, the brightness tone variation judgement process includes the following steps: setting a variance count of i row as 0; performing a variance process on k-th subpixel in i row and k-th subpixel in i+1 row, in which k=1, 2, . . . , 12; determining that the brightness tones of the subpixels in i row and i+1 row induce occurrence of the horizontal stripes when at least two of the variance count of i row, a variance count of i−1 row, and a variance count of i−2 row are larger than a variance threshold. The variance process includes the following steps: determining whether the brightness tones of k-th subpixel in i row and k-th subpixel in i+1 row are respectively the bright tone and the dark tone; and adding the variance count of i row to one when the brightness tones of k-th subpixel in i row and k-th subpixel in i+1 row are respectively the bright tone and the dark tone.

In accordance with one or more embodiments of the invention, the pattern detection manner includes the following steps: setting a failed count as 0; performing a judgement process on the subpixels in i row and i+1 row of the display panel, in which i=1, 2, . . . , N−1, in which N is number of rows of the display panel; determining that the image pattern is the killer pattern when the failed count is less than N/4; and determining that the image pattern is not the killer pattern when the failed count is not less than N/4. The judgement process includes the following steps: determining that a brightness tone of each subpixels in i row and i+1 row is a bright tone, an intermediate tone, or a dark tone; determining whether a brightness tone sequence of the brightness tones of the subpixels of first four pixels in i row is the same as a brightness tone sequence of the brightness tones of the subpixels of the other four pixels in i row; determining whether a brightness tone sequence of the brightness tones of the subpixels of first four pixels in i+1 row is the same as a brightness tone sequence of the brightness tones of the subpixels of the other four pixels in i+1 row; determining whether the brightness tones of the subpixels in i row match a specific pattern; and adding the failed count to one, when the brightness tone sequence of the brightness tones of the subpixels of first four pixels in i row is not the same as the brightness tone sequence of the brightness tones of the subpixels of the other four pixels in i row, or when the brightness tone sequence of the brightness tones of the subpixels of first four pixels in i+1 row is not the same as the brightness tone sequence of the brightness tones of the subpixels of the other four pixels in i+1 row, or when the brightness tones of the subpixels in i row do not match the specific pattern.

In accordance with one or more embodiments of the invention, the brightness tone of the subpixel is determined by comparing a gray level of the subpixel with a bright threshold and a dark threshold. The brightness tone of the subpixel is determined as the bright tone when the gray level of the subpixel is larger than the bright threshold. The brightness tone of the subpixel is determined as the dark tone when the gray level of the subpixel is less than the dark threshold. The brightness tone of the subpixel is determined as the intermediate tone when the gray level of the subpixel is not larger than the bright threshold and is not less than the dark threshold.

In accordance with one or more embodiments of the invention, the display panel is driven by a transition dependent data inversion (TDDI) driving method.

BRIEF DESCRIPTION OF THE DRAWINGS

The invention can be more fully understood by reading the following detailed description of the embodiment, with reference made to the accompanying drawings as follows:

FIG. 2A shows an example that the image pattern is the killer pattern and the display panel is driven by the 1-column inversion method according to some embodiments of the present invention.

FIG. 2B shows another example that the image pattern is the killer pattern and the display panel is driven by the 2-column inversion method according to some embodiments of the present invention.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention.

Figure 1:
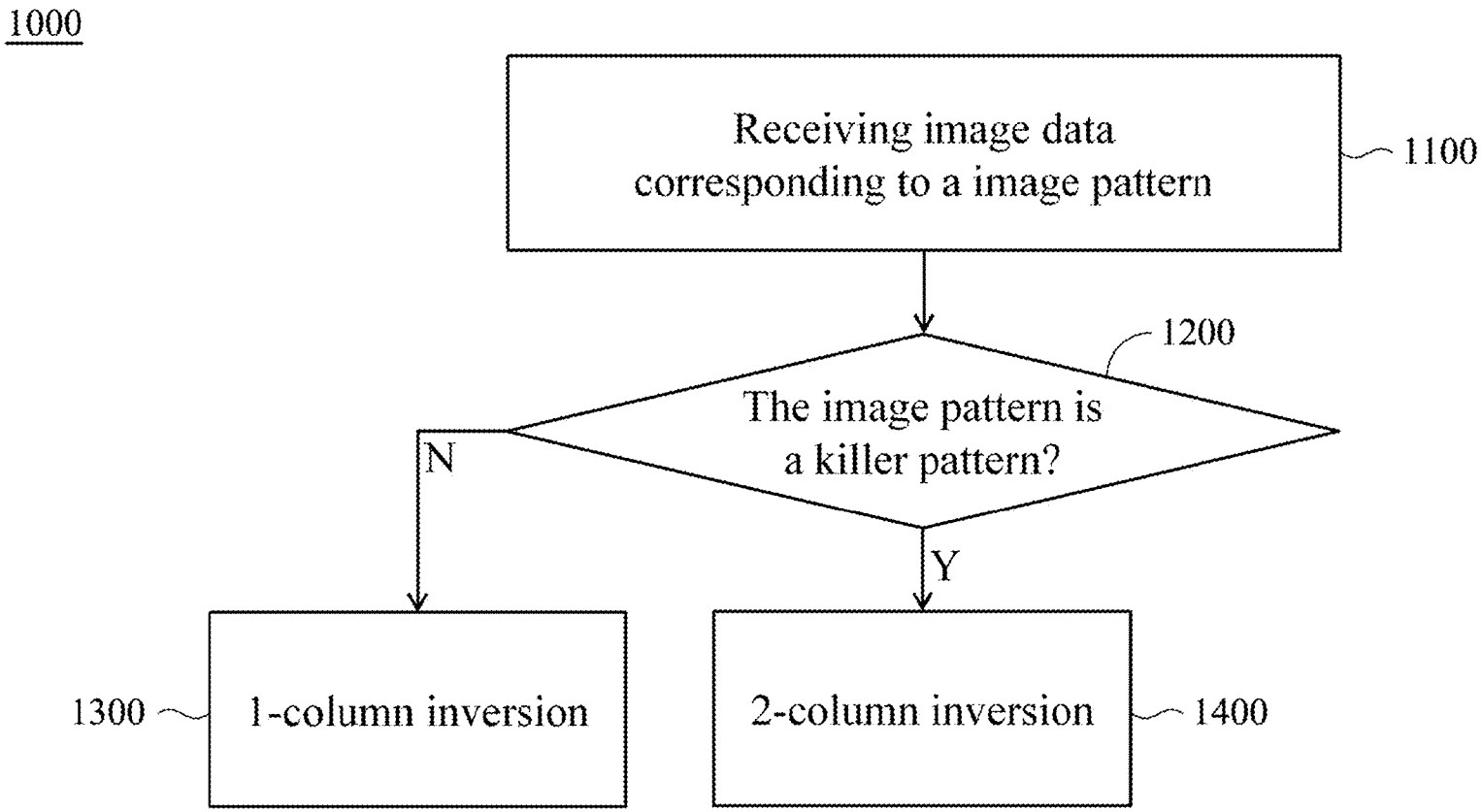
FIG. 1 illustrates a flow chart of a polarity controlling method according to some embodiments of the present invention.

FIG. 1 illustrates a flow chart of a polarity controlling method 1000 according to some embodiments of the present invention. The polarity controlling method 1000 is configured to control polarity of each subpixels of a display panel by using a pattern detection manner. As shown in FIG. 1, the polarity controlling method 1000 includes steps 1100-1400. In step 1100, image data of each subpixels of the display panel is received. In some embodiments of the present invention, the image data of the subpixels corresponds to an image pattern displayed on the display panel in a next frame subsequent to a current frame. In step 1200, the pattern detection manner is performed so as to determine whether the image pattern displayed on the display panel in the next frame is a killer pattern which induces occurrence of horizontal stripes on the display panel.

If the image pattern is not the killer pattern, a 1-column inversion method is employed to drive the display panel in the next frame (i.e., step 1300). In some embodiments of the present invention, when the display panel is driven by the 1-column inversion method, polarities of the subpixels in each rows are repetitively in a polarity sequence of "+, −, +, −". Specifically, a default driving method of the display panel is 1-column inversion method (i.e., a column inversion method), thus when the image pattern displayed in the next frame is not the killer pattern, the display panel is still driven by the 1-column inversion method so as to eliminate image retention caused by longtime DC biasing.

If the image pattern is the killer pattern, a 2-column inversion method is employed to drive the display panel in the next frame (i.e., step 1400). In some embodiments of the present invention, when the display panel is driven by the 2-column inversion method, polarities of the subpixels in each rows are repetitively in a polarity sequence of "+, −, −, +". Specifically, when the image pattern displayed in the next frame is the killer pattern, the driving method of the display panel in the next frame is changed to the 2-column inversion method so as to prevent occurrence of horizontal stripes on the display panel in the next frame.

FIG. 2A shows an example that the image pattern is the killer pattern and the display panel is driven by the 1-column inversion method. As shown in FIG. 2A, polarities and gray levels of the subpixels in i row are repetitively in a sequence of "+255, −0, +255, −0", polarities and gray levels of the subpixels in i+1 row are repetitively in a sequence of "+0, −255, +0, −255". Therefore, plural voltage variances in the longitudinal direction from i row to i+1 row for the electrode driving circuit are all extremely negative values, thereby overloading the withstand voltage of electrode driving circuit and inducing occurrence of horizontal stripes on the display panel.

FIG. 2B shows another example that the image pattern is the killer pattern and the display panel is driven by the 2-column inversion method. As shown in FIG. 2B, polarities and gray levels of the subpixels in i row are repetitively in a sequence of "+255, −0, −255, +0", polarities and gray levels of the subpixels in i+1 row are repetitively in a sequence of "+0, −255, −0, +255". Therefore, plural voltage variances in the horizontal direction from i row to i+1 row for the electrode driving circuit include extremely negative values and extremely positive values, and the extremely negative values and the extremely positive values may cancel out, thereby reducing the load of electrode driving circuit and preventing occurrence of horizontal stripes on the display panel.

Figure 3:
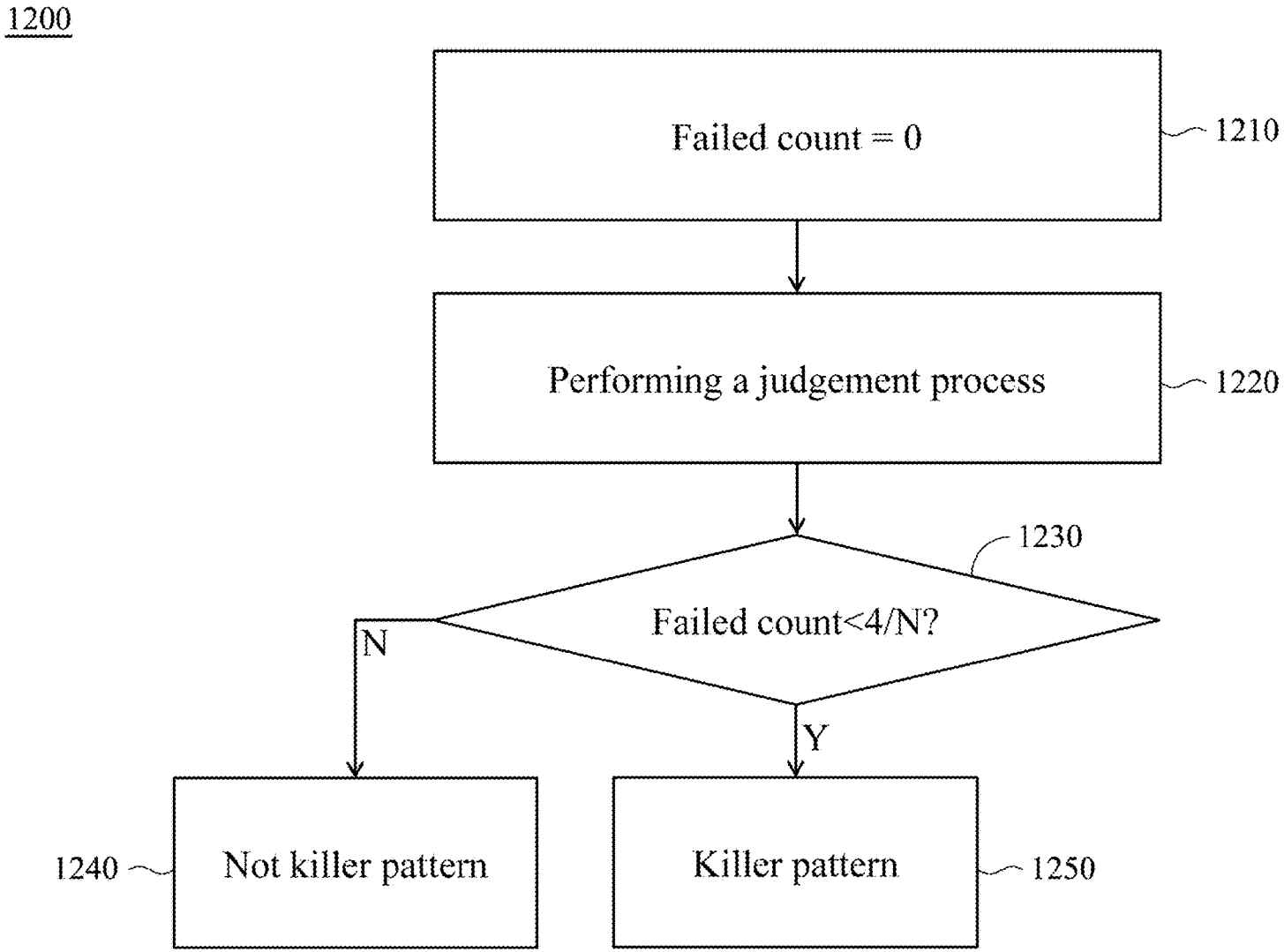
FIG. 3 illustrates a flow chart of a pattern detection manner according to some embodiments of the present invention.

The pattern detection manner of step 1200 of the polarity controlling method 1000 is further discussed below. FIG. 3 illustrates a flow chart of a pattern detection manner of step 1200 according to some embodiments of the present invention. As shown in FIG. 3, the pattern detection manner of step 1200 includes steps 1210-1250. In step 1210, a failed count is set as 0. In step 1220, a judgement process is performed on the subpixels in i row and i+1 row of the display panel, in which i=1, 2, . . . , N−1, in which N is number of rows of the display panel. In step 1230, determining whether the failed count is less than N/4. If the failed count is not less than N/4, the image pattern is determined to be not the killer pattern (i.e., step 1240). If the failed count is less than N/4, the image pattern is determined to be the killer pattern (i.e., step 1250).

The judgement process of step 1220 according to a first embodiment of the present invention is further discussed below. The judgement process 1220 of the first embodiment of the present invention includes a first step, a second step, a third step, a fourth step, and a fifth step. In the first step, a brightness tone of each subpixels in i row and i+1 row is determined to be a bright tone, an intermediate tone, or a dark tone. In some embodiments of the present invention, the brightness tone of the subpixel is determined by comparing a gray level of the subpixel with a bright threshold and a dark threshold. The brightness tone of the subpixel is determined as the bright tone when the gray level of the subpixel is larger than the bright threshold. The brightness tone of the subpixel is determined as the dark tone when the gray level of the subpixel is less than the dark threshold. The brightness tone of the subpixel is determined as the intermediate tone when the gray level of the subpixel is not larger than the bright threshold and is not less than the dark threshold. For example, if the bright threshold is 240 and the dark threshold is 15, the brightness tone of the subpixel with gray level as 255 is determined as the bright tone, the brightness tone of the subpixel with gray level as 0 is determined as the dark tone, the brightness tone of the subpixel with gray level as 100 is determined as the intermediate tone.

In the second step, determining whether a brightness tone sequence of the brightness tones of the subpixels of first four pixels in i row is the same as a brightness tone sequence of the brightness tones of the subpixels of the other four pixels in i row. In the third step, determining whether a brightness tone sequence of the brightness tones of the subpixels of first four pixels in i+1 row is the same as a brightness tone sequence of the brightness tones of the subpixels of the other four pixels in i+1 row. In the fourth step, a brightness tone variation judgement process is performed to determine whether the brightness tones of the subpixels in i row and i+1 row induce occurrence of the horizontal stripes.

In the fifth step, the failed count is added to one when the brightness tone sequence of the brightness tones of the subpixels of first four pixels in i row is not the same as the brightness tone sequence of the brightness tones of the subpixels of the other four pixels in i row, or when the brightness tone sequence of the brightness tones of the subpixels of first four pixels in i+1 row is not the same as the brightness tone sequence of the brightness tones of the subpixels of the other four pixels in i+1 row, or when the brightness tones of the subpixels in i row and i+1 row do not induce occurrence of the horizontal stripes.

Specifically, the first step, the second step, the third step, the fourth step, and the fifth step of the judgement process 1220 according to the first embodiment of the present invention are repetitively operated from i=1 to i=N−1 so as to determine the failed count.

The second step is further discussed below. The second step includes a first sub-step, a second sub-step, and a third sub-step. In the first sub-step, a first difference count is set as 0. In the second sub-step, a first comparison process is performed on the subpixels of first four pixels in i row and the subpixels of j-th four pixels in i row, in which j=2, 3, . . . , M/4, in which M is number of columns of the display panel. In the third sub-step, when the first difference count is less than 7, determining that the brightness tone sequence of the brightness tones of the subpixels of first four pixels in i row is the same as the brightness tone sequence of the brightness tones of the subpixels of the other four pixels in i row.

The third step is further discussed below. The third step includes a fourth sub-step, a fifth sub-step, and a sixth sub-step. In the fourth sub-step, a second difference count is set as 0. In the fifth sub-step, a second comparison process is performed on the subpixels of first four pixels in i+1 row and the subpixels of j-th four pixels in i+1 row. In the sixth sub-step, when the second difference count is less than 7, determining that the brightness tone sequence of the brightness tones of the subpixels of first four pixels in i+1 row is the same as the brightness tone sequence of the brightness tones of the subpixels of the other four pixels in i+1 row.

The first comparison process of the second sub-step is further discussed below. The first comparison process of second sub-step includes two steps. First, determining whether the brightness tone sequence of the brightness tones of the subpixels of first four pixels in i row is different from the brightness tone sequence of the brightness tones of the subpixels of j-th four pixels in i row. Then, when the brightness tone sequence of the brightness tones of the subpixels of first four pixels in i row is different from the brightness tone sequence of the brightness tones of the subpixels of j-th four pixels in i row, the first difference count is added to one. Specifically, the two steps of the first comparison process of the second sub-step are repetitively operated from j=2 to j=M/4 so as to determine the first difference count.

The second comparison process of the fifth sub-step is further discussed below. The second comparison process of the fifth sub-step includes two steps. First, determining whether the brightness tone sequence of the brightness tones of the subpixels of first four pixels in i+1 row is different from the brightness tone sequence of the brightness tones of the subpixels of j-th four pixels in i+1 row. Then, when the brightness tone sequence of the brightness tones of the subpixels of first four pixels in i+1 row is different from the brightness tone sequence of the brightness tones of the subpixels of j-th four pixels in i+1 row, the second difference count is added to one. Specifically, the two steps of the second comparison process of the fifth sub-step are repetitively operated from j=2 to j=M/4 so as to determine the second difference count.

The brightness tone variation judgement process of the fourth step is further discussed below. The brightness tone variation judgement process includes a seventh sub-step, an eighth sub-step, and a ninth sub-step. In the seventh sub-step, a variance count of i row is set as 0. In the eighth sub-step, a variance process is performed on k-th subpixel in i row and k-th subpixel in i+1 row, in which k=1, 2, . . . , 12. In the ninth sub-step, when at least two of the variance count of i row, a variance count of i−1 row, and a variance count of i−2 row are larger than a variance threshold, determining that the brightness tones of the subpixels in i row and i+1 row induce occurrence of the horizontal stripes. Specifically, the situation that the variance count of i row is larger than the variance threshold represents there is a large brightness tone variation between i row and i+1 row, the situation that the variance count of i−1 row is larger than the variance threshold represents there is a large brightness tone variation between i−1 row and i row, the situation that the variance count of i−2 row is larger than the variance threshold represents there is a large brightness tone variation between i−2 row and i−1 row. Therefore, the ninth sub-step represents that the large brightness tone variation between two adjacent rows happens twice in four rows (from i−2 row to i+1 row).

The variance process of the eighth sub-step is further discussed below. The variance process of the eighth sub-step includes two steps. First, determining whether the brightness tones of k-th subpixel in i row and k-th subpixel in i+1 row are respectively the bright tone and the dark tone. Then, when the brightness tones of k-th subpixel in i row and k-th subpixel in i+1 row are respectively the bright tone and the dark tone, the variance count of i row is added to one. Specifically, the two steps of the variance process of the eighth sub-step are repetitively operated from k=1 to k=12 so as to determine the variance count of i row.

The judgement process of step 1220 according to a second embodiment of the present invention is further discussed below. The judgement process 1220 of the second embodiment of the present invention includes the first step, a sixth step, a seventh step, an eighth step, and a ninth step. The first step is already discussed above, and is not repeated here to avoid duplicity.

In the sixth step, determining whether a brightness tone sequence of the brightness tones of the subpixels of first four pixels in i row is totally the same as a brightness tone sequence of the brightness tones of the subpixels of the other four pixels in i row. In the seventh step, determining whether a brightness tone sequence of the brightness tones of the subpixels of first four pixels in i+1 row is totally the same as a brightness tone sequence of the brightness tones of the subpixels of the other four pixels in i+1 row.

Figure 4:
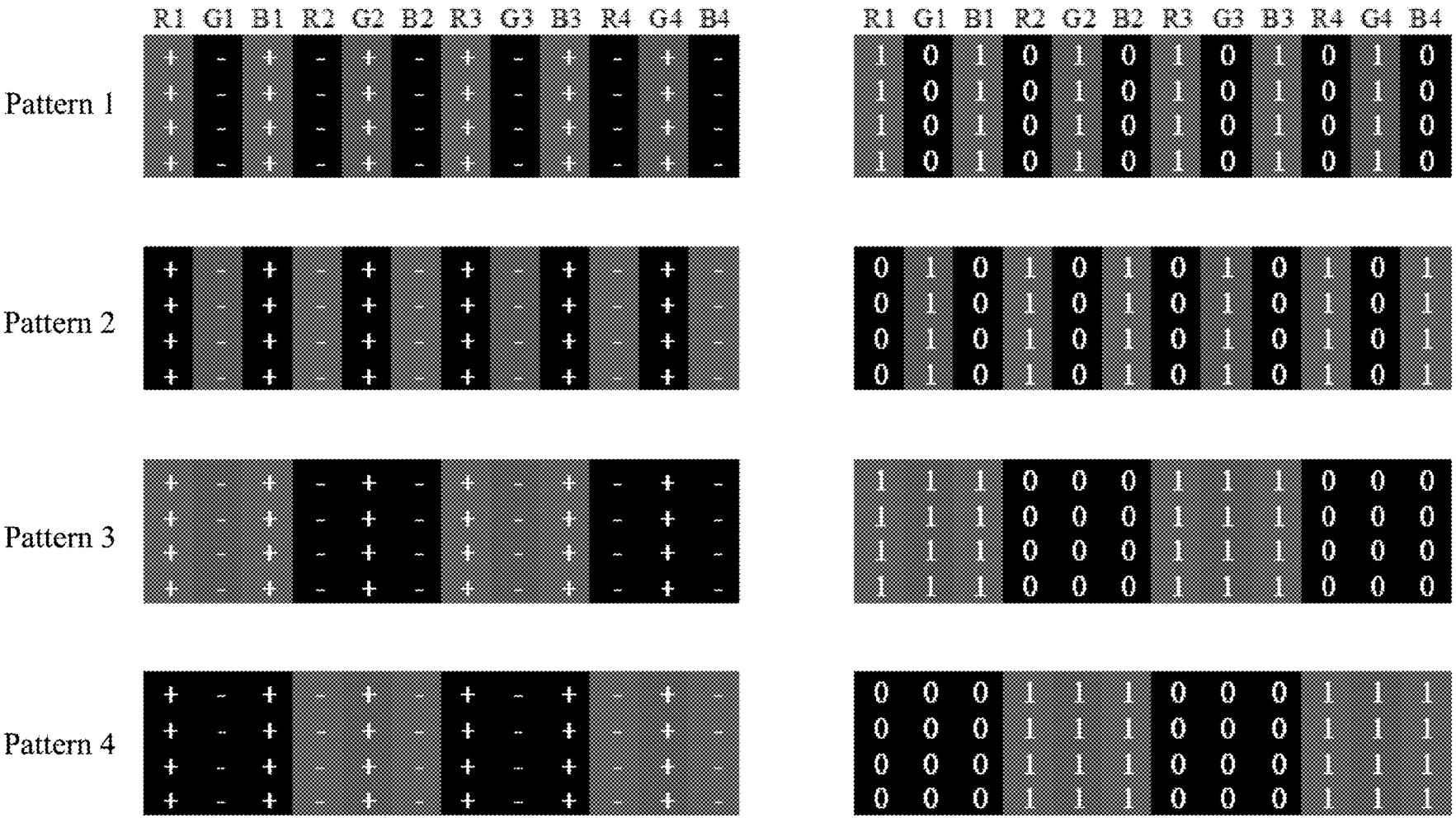
FIG. 4 shows an example of four specific patterns according to an embodiment of the present invention.

In the eighth step, determining whether the brightness tones of the subpixels in i row match the brightness tones in i row of a specific pattern. In the second embodiment of the present invention, some specific patterns are known to induce occurrence of the horizontal stripes. FIG. 4 shows an example of four specific patterns (i.e., pattern 1, pattern 2, pattern 3, and pattern 4 as shown in FIG. 4) according to the second embodiment of the present invention. The left portion of FIG. 4 shows the polarities of the subpixels of first four pixels. The right portion of FIG. 4 shows the brightness tones of the subpixels of first four pixels, in which "0" represents that the brightness tone of the subpixel is the dark tone, and "1" represents that the brightness tone of the subpixel is the bright tone.

In the ninth step, the failed count is added to one when the brightness tone sequence of the brightness tones of the subpixels of first four pixels in i row is not totally the same as the brightness tone sequence of the brightness tones of the subpixels of the other four pixels in i row, or when the brightness tone sequence of the brightness tones of the subpixels of first four pixels in i+1 row is not totally the same as the brightness tone sequence of the brightness tones of the subpixels of the other four pixels in i+1 row, or when the brightness tones of the subpixels in i row match the brightness tones in i row of the specific pattern.

Specifically, the first step, the sixth step, the seventh step, the eighth step, and the ninth step of the judgement process 1220 according to the second embodiment of the present invention are repetitively operated from i=1 to i=N−1 so as to determine the failed count.

In some embodiments of the present invention, the display panel is driven by a transition dependent data inversion (TDDI) driving method.

From the above description, the present invention discloses the polarity controlling method configured to control polarity of each subpixels of a display panel by using the pattern detection manner. The pattern detection manner is performed so as to determine whether the image pattern displayed on the display panel in the next frame is the killer pattern which induces occurrence of horizontal stripes on the display panel. If the image pattern is not the killer pattern, the display panel is driven by the 1-column inversion method in the next frame. If the image pattern is the killer pattern, the display panel is driven by the 2-column inversion method in the next frame, thereby prevent occurrence of horizontal stripes on the display panel.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A method for controlling polarity of each subpixels of a display panel by using a pattern detection manner, comprising the following steps:

receiving image data of each subpixels of the display panel, wherein the image data of the subpixels corresponds to an image pattern displayed on the display panel;

performing the pattern detection manner to determine whether the image pattern is a killer pattern which induces occurrence of horizontal stripes on the display panel;

employing a 1-column inversion method to drive the display panel when the image pattern is not the killer pattern; and employing a 2-column inversion method to drive the display panel when the image pattern is the killer pattern;

wherein the pattern detection manner comprises the following steps:

setting a failed count as 0;

performing a judgement process on the subpixels in i row and i+1 row of the display panel, wherein i=1, 2, . . . , N−1, wherein N is number of rows of the display panel, wherein the judgement process comprises the following steps:

determining that a brightness tone of each subpixels in i row and i+1 row is a bright tone, an intermediate tone, or a dark tone;

determining whether a brightness tone sequence of the brightness tones of the subpixels of first four pixels in i row is the same as a brightness tone sequence of the brightness tones of the subpixels of the other four pixels in i row;

determining whether a brightness tone sequence of the brightness tones of the subpixels of first four pixels in i+1 row is the same as a brightness tone sequence of the brightness tones of the subpixels of the other four pixels in i+1 row;

performing a brightness tone variation judgement process to determine whether the brightness tones of the subpixels in i row and i+1 row induce occurrence of the horizontal stripes; and adding the failed count to one when the brightness tone sequence of the brightness tones of the subpixels of first four pixels in i row is not the same as the brightness tone sequence of the brightness tones of the subpixels of the other four pixels in i row, or when the brightness tone sequence of the brightness tones of the subpixels of first four pixels in i+1 row is not the same as the brightness tone sequence of the brightness tones of the subpixels of the other four pixels in i+1 row, or when the brightness tones of the subpixels in i row and i+1 row do not induce occurrence of the horizontal stripes;

determining that the image pattern is the killer pattern when the failed count is less than N/4; and determining that the image pattern is not the killer pattern when the failed count is not less than N/4.

2. The method of claim 1, wherein when the display panel is driven by the 1-column inversion method, polarities of the subpixels in each rows are repetitively in a polarity sequence of "+, −, +, −";

wherein when the display panel is driven by the 2-column inversion method, polarities of the subpixels in each rows are repetitively in a polarity sequence of "+, −, −, +".

3. The method of claim 1, wherein the brightness tone of the subpixel is determined by comparing a gray level of the subpixel with a bright threshold and a dark threshold;

wherein the brightness tone of the subpixel is determined as the bright tone when the gray level of the subpixel is larger than the bright threshold;

wherein the brightness tone of the subpixel is determined as the dark tone when the gray level of the subpixel is less than the dark threshold;

wherein the brightness tone of the subpixel is determined as the intermediate tone when the gray level of the subpixel is not larger than the bright threshold and is not less than the dark threshold.

4. The method of claim 1, wherein the brightness tone sequence of the brightness tones of the subpixels of first four pixels in i row is determined to be the same as the brightness tone sequence of the brightness tones of the subpixels of the other four pixels in i row through the following steps:

setting a first difference count as 0;

performing a first comparison process on the subpixels of first four pixels in i row and the subpixels of j-th four pixels in i row, wherein j=2, 3, . . . , M/4, wherein M is number of columns of the display panel, wherein the first comparison process comprises the following steps:

determining whether the brightness tone sequence of the brightness tones of the subpixels of first four pixels in i row is different from the brightness tone sequence of the brightness tones of the subpixels of j-th four pixels in i row; and adding the first difference count to one when the brightness tone sequence of the brightness tones of the subpixels of first four pixels in i row is different from the brightness tone sequence of the brightness tones of the subpixels of j-th four pixels in i row;

determining that the brightness tone sequence of the brightness tones of the subpixels of first four pixels in i row is the same as the brightness tone sequence of the brightness tones of the subpixels of the other four pixels in i row when the first difference count is less than 7.

5. The method of claim 1, wherein the brightness tone sequence of the brightness tones of the subpixels of first four pixels in i+1 row is determined to be the same as the brightness tone sequence of the brightness tones of the subpixels of the other four pixels in i+1 row through the following steps:

setting a second difference count as 0;

performing a second comparison process on the subpixels of first four pixels in i+1 row and the subpixels of j-th four pixels in i+1 row, wherein j=2, 3, . . . , M/4, wherein M is number of columns of the display panel, wherein the second comparison process comprises the following steps:

determining whether the brightness tone sequence of the brightness tones of the subpixels of first four pixels in i+1 row is different from the brightness tone sequence of the brightness tones of the subpixels of j-th four pixels in i+1 row; and adding the second difference count to one when the brightness tone sequence of the brightness tones of the subpixels of first four pixels in i+1 row is different from the brightness tone sequence of the brightness tones of the subpixels of j-th four pixels in i+1 row;

determining that the brightness tone sequence of the brightness tones of the subpixels of first four pixels in i+1 row is the same as the brightness tone sequence of the brightness tones of the subpixels of the other four pixels in i+1 row when the second difference count is less than 7.

6. The method of claim 1, wherein the brightness tone variation judgement process comprises the following steps:

setting a variance count of i row as 0;

performing a variance process on k-th subpixel in i row and k-th subpixel in i+1 row, wherein k=1, 2, . . . , 12, wherein the variance process comprises the following steps:

determining whether the brightness tones of k-th subpixel in i row and k-th subpixel in i+1 row are respectively the bright tone and the dark tone; and adding the variance count of i row to one when the brightness tones of k-th subpixel in i row and k-th subpixel in i+1 row are respectively the bright tone and the dark tone;

determining that the brightness tones of the subpixels in i row and i+1 row induce occurrence of the horizontal stripes when at least two of the variance count of i row, a variance count of i−1 row, and a variance count of i−2 row are larger than a variance threshold.

7. The method of claim 1, wherein the display panel is driven by a transition dependent data inversion (TDDI) driving method.

8. A method for controlling polarity of each subpixels of a display panel by using a pattern detection manner, comprising the following steps:

receiving image data of each subpixels of the display panel, wherein the image data of the subpixels corresponds to an image pattern displayed on the display panel;

performing the pattern detection manner to determine whether the image pattern is a killer pattern which induces occurrence of horizontal stripes on the display panel;

employing a 1-column inversion method to drive the display panel when the image pattern is not the killer pattern; and employing a 2-column inversion method to drive the display panel when the image pattern is the killer pattern;

wherein the pattern detection manner comprises the following steps:

setting a failed count as 0;

performing a judgement process on the subpixels in i row and i+1 row of the display panel, wherein i=1, 2, . . . , N−1, wherein N is number of rows of the display panel, wherein the judgement process comprises the following steps:

determining that a brightness tone of each subpixels in i row and i+1 row is a bright tone, an intermediate tone, or a dark tone;

determining whether a brightness tone sequence of the brightness tones of the subpixels of first four pixels in i row is the same as a brightness tone sequence of the brightness tones of the subpixels of the other four pixels in i row;

determining whether a brightness tone sequence of the brightness tones of the subpixels of first four pixels in i+1 row is the same as a brightness tone sequence of the brightness tones of the subpixels of the other four pixels in i+1 row;

determining whether the brightness tones of the subpixels in i row match a specific pattern; and adding the failed count to one, when the brightness tone sequence of the brightness tones of the subpixels of first four pixels in i row is not the same as the brightness tone sequence of the brightness tones of the subpixels of the other four pixels in i row, or when the brightness tone sequence of the brightness tones of the subpixels of first four pixels in i+1 row is not the same as the brightness tone sequence of the brightness tones of the subpixels of the other four pixels in i+1 row, or when the brightness tones of the subpixels in i row do not match the specific pattern;

determining that the image pattern is the killer pattern when the failed count is less than N/4; and determining that the image pattern is not the killer pattern when the failed count is not less than N/4.

9. The method of claim 8, wherein the brightness tone of the subpixel is determined by comparing a gray level of the subpixel with a bright threshold and a dark threshold;

wherein the brightness tone of the subpixel is determined as the bright tone when the gray level of the subpixel is larger than the bright threshold;

wherein the brightness tone of the subpixel is determined as the dark tone when the gray level of the subpixel is less than the dark threshold;

wherein the brightness tone of the subpixel is determined as the intermediate tone when the gray level of the subpixel is not larger than the bright threshold and is not less than the dark threshold.

* * * * *